US007293761B2

(12) United States Patent
Malek et al.

(10) Patent No.: US 7,293,761 B2
(45) Date of Patent: Nov. 13, 2007

(54) DIAGNOSTIC SYSTEM FOR CRANES

(75) Inventors: Glenn Malek, Collegeville, PA (US); Jeffrey Griesemer, Fleetwood, PA (US); Oddvar Norheim, Douglassville, PA (US)

(73) Assignee: American Crane & Equipment Corporation, Douglassville, PA (US)

( * ) Notice: Subject to any disclaimer, the term of this patent is extended or adjusted under 35 U.S.C. 154(b) by 391 days.

(21) Appl. No.: 10/965,544

(22) Filed: Oct. 14, 2004

(65) Prior Publication Data

US 2005/0098768 A1 May 12, 2005

Related U.S. Application Data

(60) Provisional application No. 60/511,932, filed on Oct. 16, 2003.

(51) Int. Cl.
*B66D 1/50* (2006.01)

(52) U.S. Cl. ..... 254/275

(58) Field of Classification Search ..... 254/267, 254/268, 273, 274, 275, 276
See application file for complete search history.

(56) References Cited

U.S. PATENT DOCUMENTS 4,073,476 A * 2/1978 Frank ..... 254/285
4,175,727 A * 11/1979 Clarke ..... 254/274
4,177,973 A * 12/1979 Miller et al. ..... 254/276
4,493,479 A * 1/1985 Clark ..... 254/274
5,133,465 A * 7/1992 Kalan ..... 212/285
5,350,076 A * 9/1994 Kalan ..... 212/315
5,489,032 A * 2/1996 Mayhall et al. ..... 212/285
5,625,262 A * 4/1997 Lapota ..... 318/71
5,671,912 A * 9/1997 Langford et al. ..... 254/267
6,029,951 A * 2/2000 Guggari ..... 254/269
6,092,789 A * 7/2000 Christopher et al. ..... 254/274
6,300,884 B1 10/2001 Wilson
6,496,766 B1 12/2002 Bernold et al.
6,547,220 B2 * 4/2003 Johnson ..... 254/331
6,598,859 B1 * 7/2003 Kureck et al. ..... 254/292
6,655,662 B2 * 12/2003 Kemppainen ..... 254/275
6,710,574 B2 * 3/2004 Davis et al. ..... 318/800
6,966,544 B2 * 11/2005 McCormick et al. ..... 254/342

* cited by examiner

*Primary Examiner*—Emmanuel M Marcelo
(74) *Attorney, Agent, or Firm*—Knoble Yoshida & Dunleavy, LLC

(57) ABSTRACT

A hoist system for critical loads incorporates improved safety technology to monitor various possible fault conditions. For example, a command-not-operated function causes braking of the hoist when an encoder detects one of a group of conditions including a lack of load movement when a movement command is issued by the operating system, failure of encoder feedback, or failure of a control circuit. An uncommanded motion function also causes braking of the hoist when an encoder detects one of a group of conditions including load movement without a movement command issued by the operating system, or reverse directional movement of the load from a directional movement command input by the operating system.

32 Claims, 15 Drawing Sheets

DIAGNOSTIC SYSTEM FOR CRANES

This application claims priority under 35 U.S.C. §119(e) based on U.S. Provisional Application Ser. No. 60/511,932, filed Oct. 16, 2003, the entire disclosure of which is hereby incorporated by reference as if set forth fully herein.

BACKGROUND OF THE INVENTION

1. Field of the Invention

The invention relates to the field of cranes. In particular the invention relates to cranes used in lift operations and providing a controller that automatically halts the crane in the event of certain potentially dangerous conditions.

2. Description of the Related Technology

Many cranes, such as nuclear fuel-handling cranes, require extreme failure-proofing safety measures because the potential consequences of dropping a load may be disastrous. In response to safety concerns arising out of the handling and transport of critical nuclear materials, regulations have been promulgated requiring a type of reeving that is described as single failure proof. Although having a crane be single failure proof is effective in limiting accidents, there are additional measures that can be taken to ensure the safety of those working with the cranes.

In the past some measures have been taken to monitor the operation of a crane, however there are possible scenarios that these monitoring systems fail to take into account. Usually, current monitoring systems compensate for only one or two possible problematic scenarios. Typically these systems do not take into account various additional scenarios that can occur during the operation of cranes. Failure of these past systems to recognize additional fault scenarios creates unnecessary risk to the people who work with the cranes. Additional monitoring systems can be especially important in critical lift hoists where leaving even the most minimal of unsafe conditions unchecked can lead to extremely dangerous conditions.

It is very important in the operation of single failure proof critical lift hoists that safety mechanisms are in place to prevent a dangerous scenario (e.g. the potential dropping of the critical load) from developing. A single accident with a crane moving highly volatile, toxic, or massive loads can be devastating. Serious damage and harm may arise in the event that any one of numerous unsafe conditions remains unchecked during the operation of a critical lift hoist. It is therefore necessary to provide immediate responses to the dangerous conditions that may arise during the operation of critical lift hoists. Additionally, it is important to have these types of monitoring systems used in the operation of standard cranes to prevent potential economic damage that may arise due to operating in unsafe conditions.

Therefore, there exists a need for providing in cranes that lift both standard and critical loads a controller that monitors the operation of the crane that implements improved safety technology to monitor various possible fault conditions.

SUMMARY OF THE INVENTION

Accordingly, it is an object of the invention to provide a controller that institutes improved safety technology to monitor various possible fault conditions during the operation of cranes.

According to a first aspect of the invention, a hoisting system is disclosed that has a hoist for lifting a load, brakes connected to the hoist and an operating system for operating the hoist. The system also has a controller for providing single failure proof operation having a command-not-operated function that causes braking of the hoist when an encoder detects one of a group of conditions consisting of; (1) a lack of load movement when a movement command is issued by the operating system, (2) failure of encoder feedback, or (3) failure of a control circuit.

According to a second aspect of the invention, a hoisting system is disclosed having a hoist for lifting a load, brakes connected to the hoist and an operating system for operating the hoist. The system also has a controller for providing single failure proof operation that has an uncommanded motion function that causes braking of the hoist when an encoder detects one of a group of conditions consisting of; (1) load movement without a movement command issued by said operating system, or (2) reverse directional movement of the load from a directional movement command input by the operating system.

According to a third aspect of the invention, a method of retrofitting a crane assembly with an improved controller is disclosed having the steps of providing a controller providing a single failure proof operation comprising a command-not-operated function that causes braking of a hoist when an encoder detects one of a group of conditions consisting of; (1) a lack of load movement when a movement command is issued by the operating system, (2) failure of encoder feedback, or (3) failure of a control circuit.

According to a fourth aspect of the invention a method of retrofitting a crane assembly with an improved controller is disclosed having the steps of providing a controller providing a single failure proof operation comprising an uncommanded motion function that causes braking of a hoist when an encoder detects one of a group of conditions consisting of; (1) load movement without a movement command issued by the operating system, or (2) reverse directional movement of a load from a directional movement command input by the operating system.

According to a fifth aspect of the invention, a method of providing a hoisting diagnostic system is disclosed having the steps of operating an operating system for moving the lift crane, issuing a command to move the load with the operating system, detecting non-movement of the load with an encoder; transmitting a signal from the encoder to a controller, comparing the command to move with the signal from the encoder, transmitting from the controller a command to a braking system, and then braking the lift crane.

According to a sixth aspect of the invention, a method for providing a hoisting diagnostic system is disclosed having the steps of detecting movement of a load with an encoder; transmitting a signal from the encoder to a controller; transmitting a signal from an operating system for commanding movement of the load to the controller; comparing the signal from the encoder with the signal from the operating system; transmitting from the controller a command to a braking system and braking the lift crane.

According to a seventh aspect of the invention, a hoisting diagnostic apparatus having a controller for providing single failure proof operation is disclosed having a command-not-operated function that causes braking of the hoist when an encoder detects one of a group of conditions consisting of; (1) a lack of load movement when a movement command is issued by a operating system, (2) failure of encoder feedback, or (3) failure of a control circuit.

According to an eighth aspect of the invention, a hoisting diagnostic apparatus is disclosed having a controller for providing single failure proof operation comprising; an uncommanded motion function that causes braking of a hoist when an encoder detects one of a group of conditions consisting of; (1) load movement without a movement command issued by a operating system, or (2) reverse directional movement of a load from a directional movement command input by said operating system.

According to a ninth aspect of the invention, a hoisting diagnostic apparatus having a controller for operating a crane is disclosed having a complex programmable logic device for receiving signals, a processor for interfacing with the complex programmable logic device, and wherein the complex programmable logic device is programmed with encoder counter logic.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
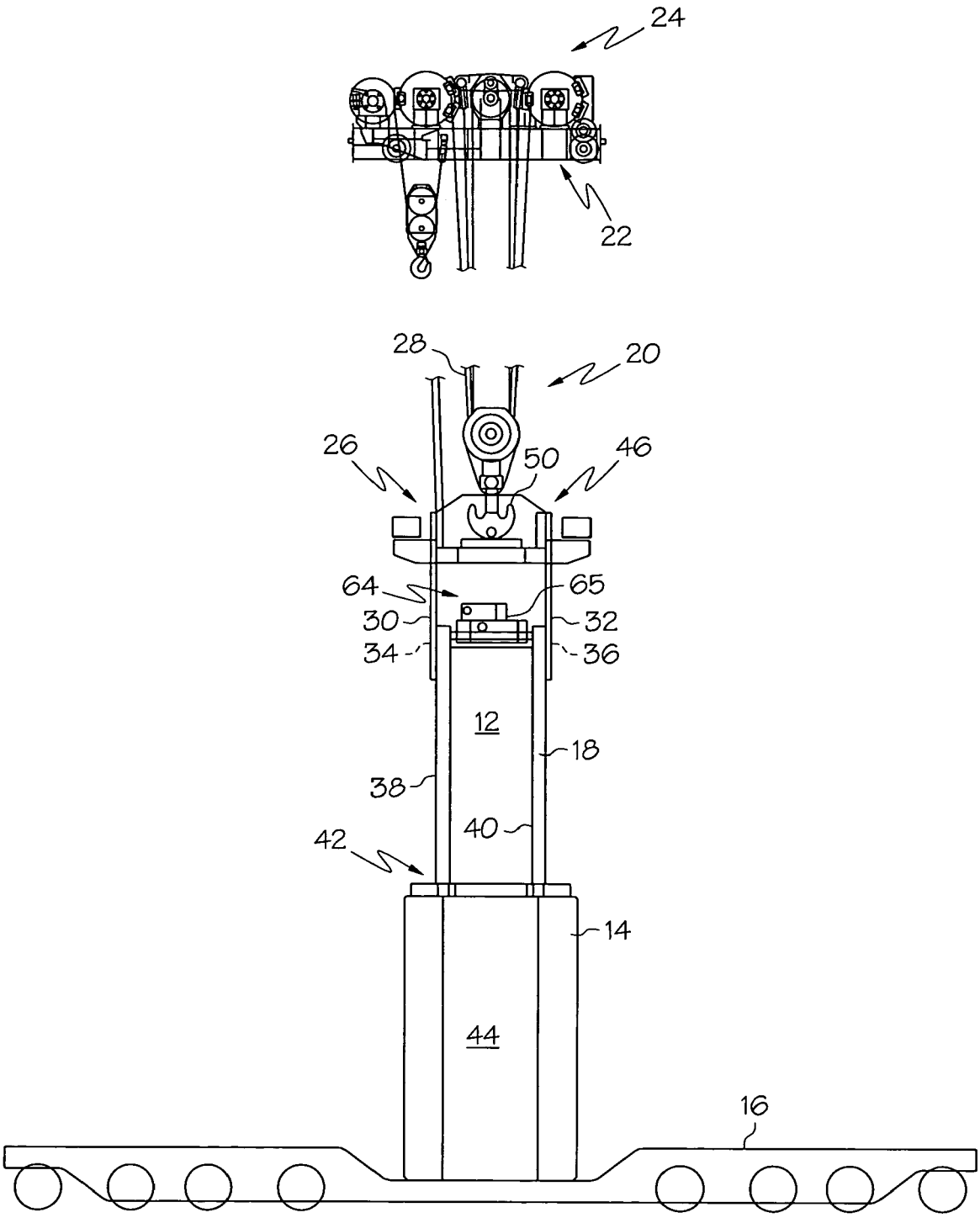
FIG. 1 is a diagrammatical depiction of a system for moving a critical load.

Referring now to the drawings, wherein like reference numerals designate corresponding structure throughout the views, and referring in particular to FIG. 1, a crane that is constructed according to a preferred embodiment of the invention is shown moving a load, which in the illustrated embodiment is a canister 12. Canister 12 may be a critical load, such as spent nuclear fuel, hot metal, or military ordnance. A critical load could also be any load that may cause significant economic damage if involved in an accident. In the illustrated embodiment, canister 12 moved to a storage cask 14, which is mounted for transport upon a trolley 16. As may be seen in FIG. 1, canister 12 is temporarily positioned inside transfer cask 18 while it is being moved from a first location to a final resting space 44 that is defined within storage cask 14. Transfer cask 18 is preferably fabricated from steel, although it can be constructed from another similar material, and has a pair of opposed lifting lugs 34, 36 that are integral with an outer wall 38. Lifting lugs 34, 36 may be used to lift and reposition transfer cask 18 during operation. Transfer cask 18 further has an internal space defined by an inner wall 40 for receiving canister 12 and a gate mechanism 42 positioned at the bottom thereof for retaining canister 12 until it is properly positioned to be lowered into the storage cask 14.

Referring again to FIG. 1, a first lifting mechanism 20 is constructed and arranged to engages transfer cask 18 and move transfer cask 18 from a first position to a position that is immediately adjacent to and above storage cask 14. In the example shown, first lifting mechanism 20 is constructed as a single failure proof critical lift hoist 22 having an upper block assembly 24 and a lower block assembly 26 that is suspended from the upper block assembly 24 by a reeving arrangement 28. Suspended from lower block assembly 26 is a first lifting hook that is configured and spaced and sized so as to be able to engage the first lifting lug on transfer cask 18 and a second lifting hook that is likewise constructed for engaging the opposed second lifting lug 36 during operation. It should be understood that the description of the lifting hooks as being suspended from the lower block assembly 26 should be construed as descriptive of any mechanical arrangement wherein the lifting hooks move substantially with the lower block assembly 26, regardless of whether they are actually mounted on the lower block assembly or one another component, such as part of the hoist mechanism, that in turn is mounted on lower block assembly 26.

Also shown is second lifting mechanism 46 that in this example is attached to the lower block assembly 26 of the first lifting mechanism 20. An electric motor 50 is provided to engage and disengage canister grab system 64 with lid portion 65. In operation, canister 12 will first be positioned and secured within transfer cask 18 and transfer cask 18 will then be engaged by first lifting mechanism 20, specifically by the engagement of lifting hooks 30, 32 with the corresponding lifting lugs 34, 36 on the sides of outer wall 38 of the transfer cask 18. At this point, first lifting mechanism 20 and specifically crane 22 will be used to move the transfer cask 18 and the enclosed canister 12 to a position (as is shown in FIG. 1) immediately above the storage cask 14.

Figure 2:
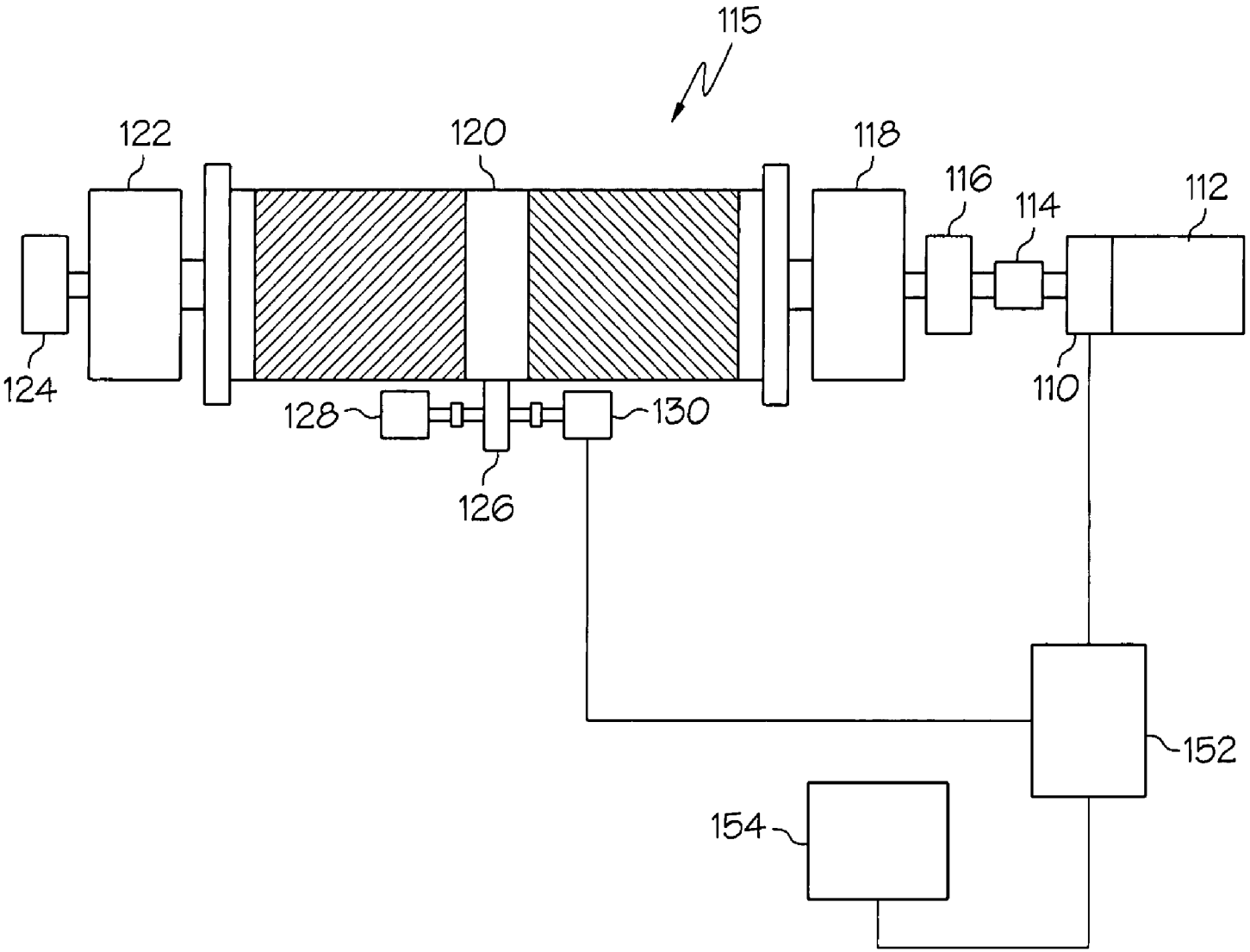
FIG. 2 is a schematic depiction of a hoist with a single drum arrangement.
Figure 3:
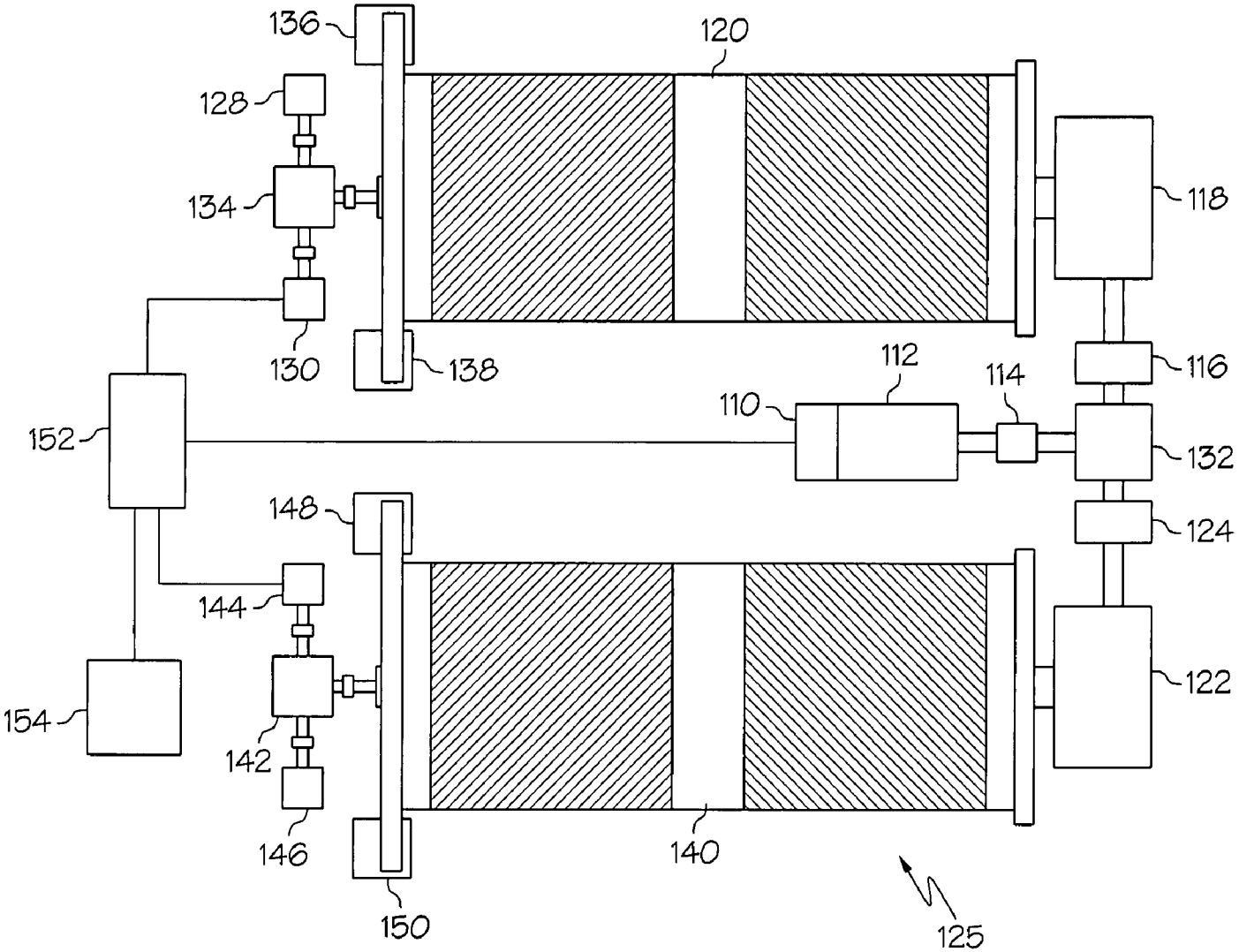
FIG. 3 is a schematic depiction of a hoist with a twin drum arrangement.

FIGS. 2 and 3 are detailed schematics of two possible embodiments of drum arrangements according to the preferred embodiments of the invention. Although the drum arrangements depicted in FIGS. 2 and 3 are described with respect to being part of a single failure proof system it is to be understood that the drum arrangements shown may also part of other types of crane and lifting systems as well and are not limited to single failure proof systems. Furthermore it is also contemplated that loads may take other forms and geometries other than drums, and may be any shape or geometry, including an oblong configuration.

Single drum arrangement hoist 115, shown in FIG. 2, may be placed within upper block assembly 24 shown in FIG. 1, or alternatively could be used in another type of crane. FIG. 3 shows a twin drum arrangement hoist 125 that may be used within upper block assembly 24 shown in FIG. 1. Single drum arrangement hoist 115 and twin drum arrangement hoist 125 are used for the lifting of loads or critical loads.

Critical loads can be any one of number of loads that can be potentially dangerous if dropped or if the load strikes a nearby building. A critical load can be for example, nuclear material, ordnance, or a load that can cause economic or physical harm if an accident were to occur.

Referring now to FIG. 2, single drum arrangement hoist 115 has a high-speed motor encoder 110. High-speed motor encoder 110 detects the rotational signal of hoist drive motor 112, also known as the high-speed driveline rotational signal. Connected to hoist drive motor 112 is a high-speed driveline clutch 114. Also provided proximate to the side of drum 120 closest to hoist drive motor 112 is a primary holding shoe brake 116 for stopping movement and a primary high reduction gearbox 118. Provided at the opposite side of drum 120 are secondary holding shoe brake 124 and secondary high reduction gearbox 122. Located proximate to drum 120 in single drum arrangement 115 is low speed reduction gearbox 126, geared limit switch 128, and load encoder 130. Load encoder 130 is configured to detect a drum rotational signal, also known as the low speed driveline rotational signal.

High-speed motor encoder 110 and load encoder 130 preferably utilize quadrature sensors. Quadrature sensors are useful for determining both rotational speed and direction. In alternative embodiments high-speed motor encoder 110 and load encoder 130 have individual processors that decode the direction and rate from the data provided by the encoders, thus offloading the processing needed by controller 152 and thereby providing faster response time to faults. Both the motor encoder 110 and load encoder 130 are connected to controller 152, which acts as the hoist drive train diagnostic system. Controller 152 provides output to hoist control interface 154, and also receives input via control interface 154.

Referring now to FIG. 3, twin drum arrangement hoist 125 has a high-speed motor encoder 110. High-speed motor encoder 110 detects the rotational signal of hoist drive motor 112, also known as the high-speed driveline rotational signal. Connected to hoist drive motor 112 is high-speed driveline clutch 114. Hoist drive motor 112 and high-speed driveline clutch 114 are connected through high-speed splitter gearbox 132. Connected to high-speed splitter gearbox is primary holding shoe brake 116 for halting drum 120 and secondary holding shoe brake 124 for halting drum 140.

Connected to both drum 120 and primary holding shoe brake 116 is high reduction gearbox 118. Connected to both drum 140 and secondary shoe brake 124 is high-speed reduction gearbox 122. Located on the opposite end of drum 120 from high reduction gearbox 118 are geared limit switch 128, low speed splitter gearbox 134 and load encoder 130, which is one of the two load encoders in this embodiment. Load encoder 130 detects a load rotational signal, also known as the low speed driveline rotational signal for drum 120.

Located on the opposite end of drum 140 from high reduction gearbox 122 are geared limit switch 144, low speed splitter gearbox 142 and load encoder 146, which with load encoder 130 acts as one of the two load encoders for this embodiment. Load encoder 146 detects a load rotational signal, also known as the low speed driveline rotational signal, for drum 140. Connected to the ends of drum 120 are emergency disc brake 136 and emergency disc brake 138. Connected to the ends of drum 140 are emergency disc brake 148 and emergency disc brake 150.

High-speed motor encoder 110, load encoder 130 and load encoder 146 utilize quadrature sensors, which again are useful for determining both rotational speed and direction. In alternative embodiments, high-speed motor encoder 110, load encoder 130, and load encoder 146 have individual processors that decode the direction and rate from the data provided by the encoders, thus offloading the processing needed by controller 152 and providing faster response time to faults. Motor encoder 110, load encoder 130, and load encoder 146 are connected to controller 152, which acts as the hoist drive train diagnostic system. Controller 152 provides output to hoist control interface 154, and also receives input via control interface 154.

Figure 4:
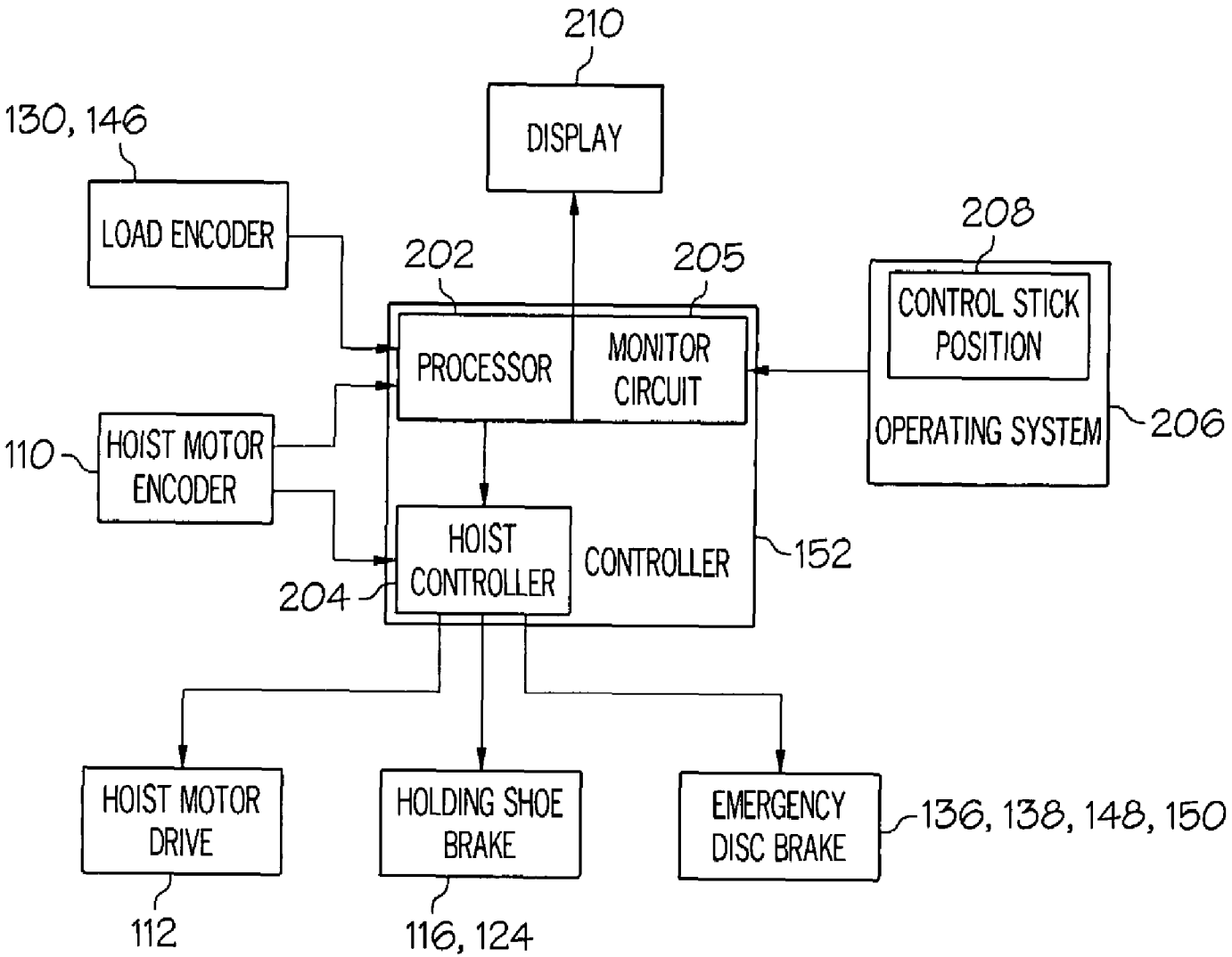
FIG. 4 is a block diagram showing component interaction with a controller.

FIG. 4 shows a diagram depicting the interaction of various components that interact with controller 152, which is the hoist drive train diagnostic system in twin drum arrangement hoist 125, shown in FIG. 3. However, the hardware depicted in FIG. 4 can also be used with single drum arrangement hoist 115. Controller 152 via processor 202 interprets the data received from load encoders 130, and 146, and hoist motor encoder 110. Controller 152 also receives information from operating system 206 related to control stick position 208. Operating system 206 is part of control interface 154 shown in FIGS. 2 and 3. Controller 152 via processor 202 uses the data received from load encoders 130, 146, hoist motor controller 110, and operating system to supply display 210 with information for an operator. Processor 202 further uses the data to determine dangerous situations. Controller 152 uses this data to operate hoist controller 204, which can directly control hoist drive motor 112, holding shoe brakes 116, 124, and emergency disc brakes 136, 138, 148, 150. This direct control over hoist drive motor 112, holding shoe brakes 116, 124, and emergency disc brakes 136, 138, 148, 150 permits immediate activation of safety procedures in the event of a potentially unsafe scenario.

Monitoring circuit 205 monitors operation of processor 202 for both hardware and software failure and further monitors the power supply. Monitoring circuit 205 alerts the operator as to when an error condition is occurring within the internal structure of controller 152 and with the actual operation of the crane. Monitoring circuit 205 can also trigger a safe shut down of hoist 125. In an alternative embodiment, monitoring circuit 205 may be external to controller 152 and can be interfaced to a main line contactor. The functioning of monitoring circuit 205 is explained in greater detail.

Figure 5:
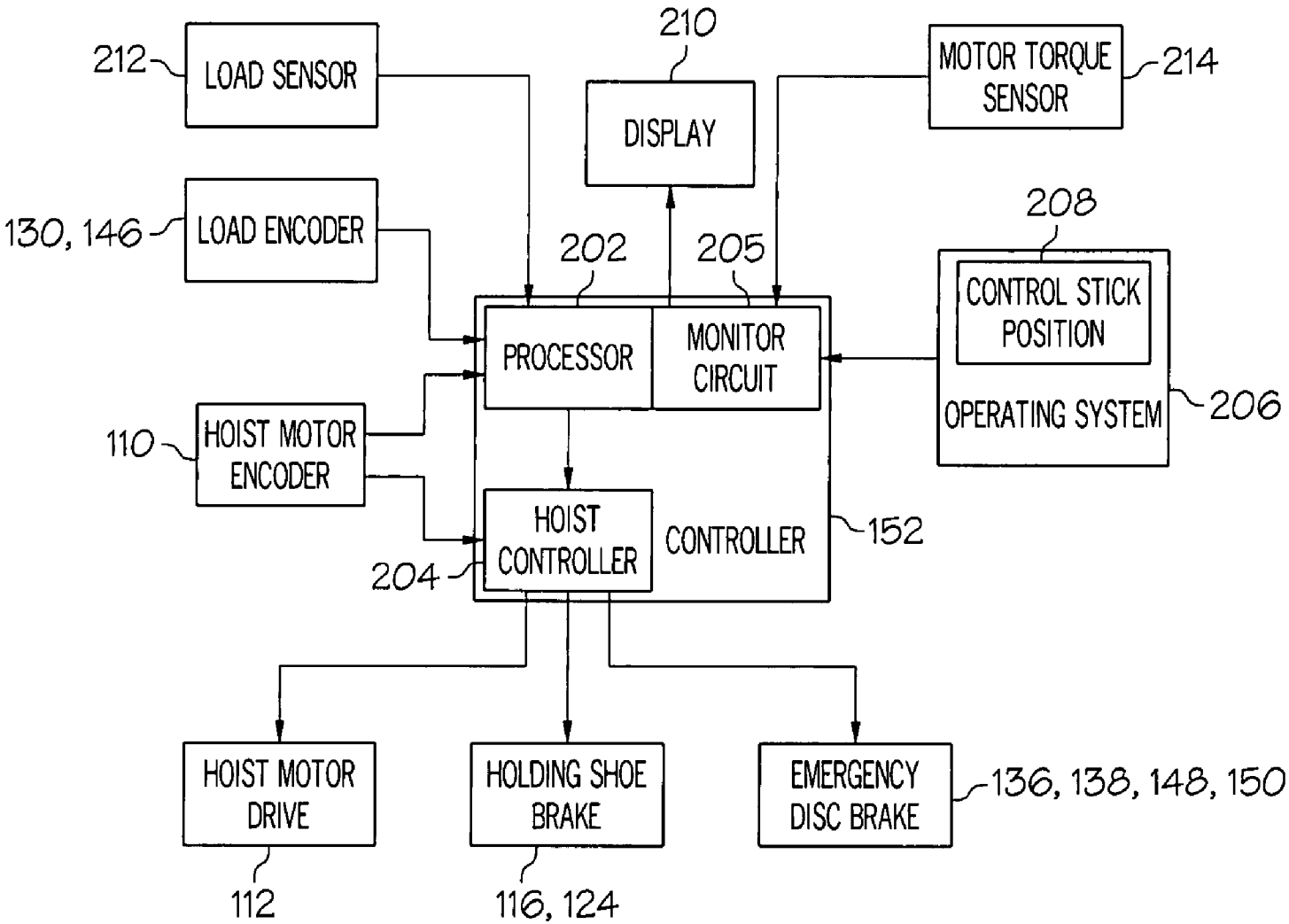
FIG. 5 is a block diagram of an alternative embodiment showing component interaction with a controller.

FIG. 5 shows a diagram depicting the interaction of various components that interact with controller 152 in a twin drum arrangement hoist 125, shown in FIG. 3, and also shows the addition of two additional sensors, load sensor 212 and motor torque sensor 214. Load sensor 212 can be utilized to directly analyze aspects of a load during operation of twin drum arrangement hoist 125. Additionally, motor torque sensor 214 can operate with load sensor 212 by comparing received data at processor 202 located on controller 152. A revised quadrature differential line receiver circuit can also be installed that will monitor the health of an encoder.

Referring to FIGS. 1, 3 and 4 by way of example, some of the functions provided for by controller 152 that can trigger braking of hoist 125 will now be described.

Figure 6:
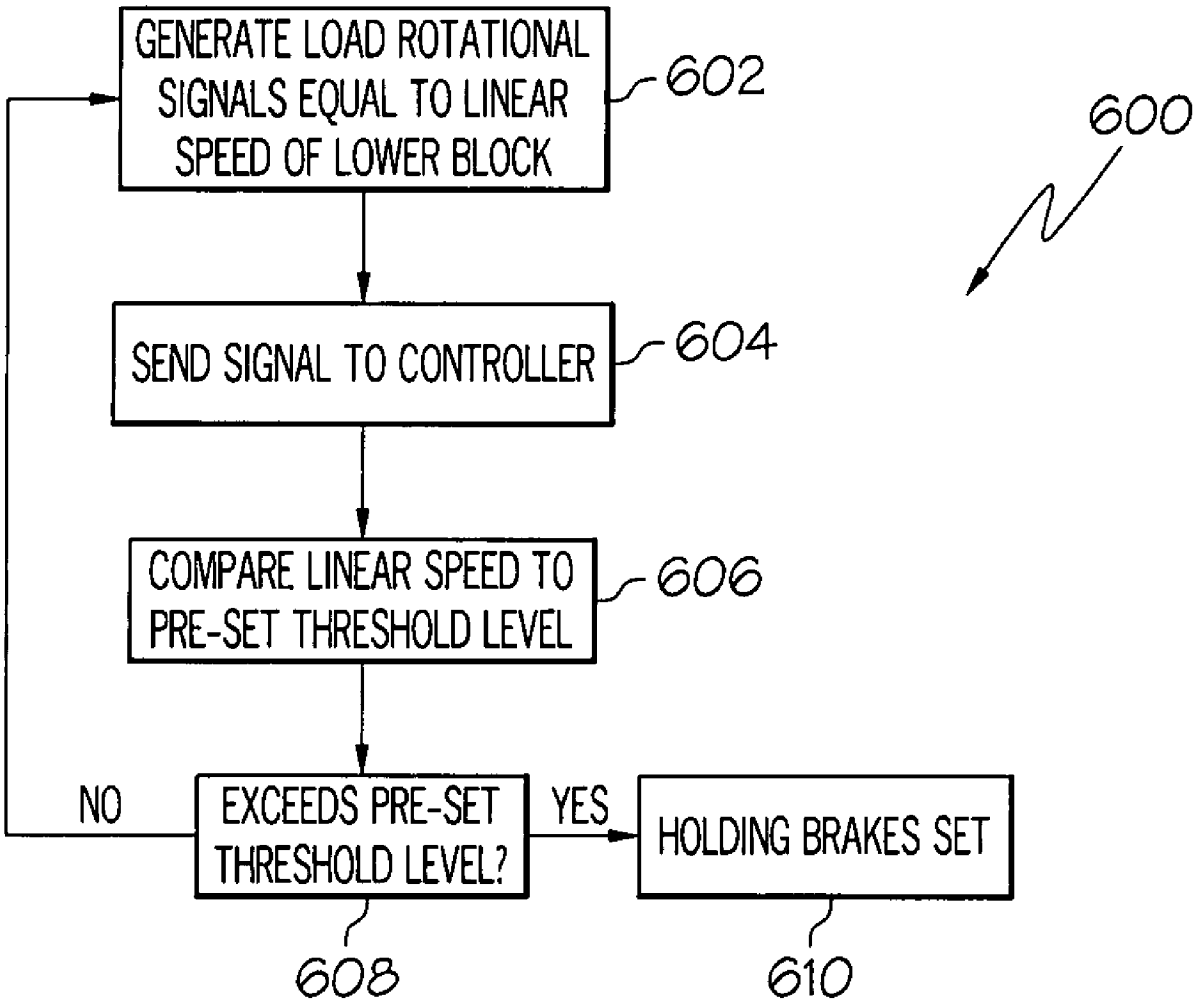
FIG. 6 is a flow chart showing a method for performing an overspeed function.

Controller 152 initiates the overspeed function 600, shown in FIG. 6, during the following scenario. The overspeed condition of hoist 125 is detected by generating a load (low speed driveline) rotational signal detected by one of the load encoders 130, 146 equal to the linear speed of lower block 26 compared to a preset threshold limit. The speed of lower block 26 is generated by encoders that are physically mounted on the low speed shafting on the far end of any other controlling equipment. Lower block speed must be generated by equipment mounted to the low speed shafting (drum) and can be accomplished by load encoders 130, 146. If the linear speed of lower block 26 exceeds a threshold limit then holding brakes 116, 124 are set with no intentional time delay. Setting holding brakes 116 or 124 disables hoist drive motor 112 and hoist drive motor 112 can not be restarted until the fault is cleared in the system. The threshold limit is adjustable based on whether a critical or non-critical load is being lifted. Preferably this function will detect an overspeed condition in either an upwards or downwards direction that exceeds 115% of critical maximum lift of lowering speed, or alternatively for non-critical loads, 115% of non-critical maximum lift or lowering speed. However, the threshold can be adjusted upwards or downwards accordingly in certain scenarios depending on circumstances (e.g. no more than 80% of critical maximum lift should be exceeded in a highly sensitive scenario, or 130% may be permitted in a non sensitive scenario). This can be accomplished by having a number of pre-set points located on operating system 206 that can be set by the operator to indicate varying degrees of desired sensitivity. Ideally, there will be no time delay on output from controller 152 to holding brakes 116, 124 when an overspeed fault is detected.

FIG. 6 shows the steps taken for performing overspeed function 600. In step 602, load encoder 130, or load encoder 146, shown in FIGS. 3 and 4, generates a load rotational signal equal to linear speed of lower block. In step 604 the signal is sent to controller 152, shown in FIG. 4. In step 606 linear speed is compared to a pre-set threshold level by processor 202, shown in FIG. 4. The pre-set threshold can be adjusted for whether a critical load or a non-critical load is being hoisted. Typically the pre-set threshold is set so that holding shoes brakes 116 and 124 are triggered upon reaching 105%-125% of the critical load hoist speed. The pre-set threshold can also be set so that when hoisting non-critical loads holding shoes brakes 116 and 124 are triggered upon reaching 105-125% of the non-critical load hoist speed. These can be adjusted depending upon the sensitivity of the scenario. In step 608 it is determined whether or not the linear speed exceeds a pre-set threshold level. If the answer is no then steps 602-608 are performed again. If the answer is yes, then step 610 occurs and holding shoe brakes 116, and 124, shown in FIGS. 3 and 4 are set.

The drive train discontinuity function 700, shown in FIG. 7, will now be discussed. The differential condition of hoist 125 is detected by generating a load (low speed driveline) rotational signal from load encoder 130, or 146 and comparing this signal at processor 202 to the hoist motor (high speed driveline) rotational signal generated by hoist motor encoder 110. Additionally a clock is used in order to provide a reference for the system. Typically a 20 MHz clock is used. Load encoders 130, or 146, when in use, are gated to the clock. Load encoders 130 and 146 are gated to the clock because the pulses received from motor encoder 110 are generated too rapidly to provide an effective frame of reference. Load encoder, 130 or 146 informs the clock as to when to initiate clock pulses and when to cease the clock. The resulting ratio comparison between the two is known as drive train continuity detection. The speed difference of drum 120, or drum 140 movement detected by either load encoder 130, or load encoder 146, to hoist drive motor 112 movement detected by hoist motor encoder 110 is calculated and compared by processor 202 with a ratio window in both a lifting and a lowering direction. If a predetermined ratio difference between the two drivelines is exceeded, holding shoe brakes 116, and 124, and emergency disc brakes 136, 138, 148, and 150 are set with no intentional time delay. Controller 152 via processor 202 calculates a predetermined time delay (i.e. a rotation count delay) to compensate for backlash through the driveline, couplings, and gearboxes. In alternative embodiments a separate processor may be employed to perform the calculations based upon the signals received.

Figure 7:
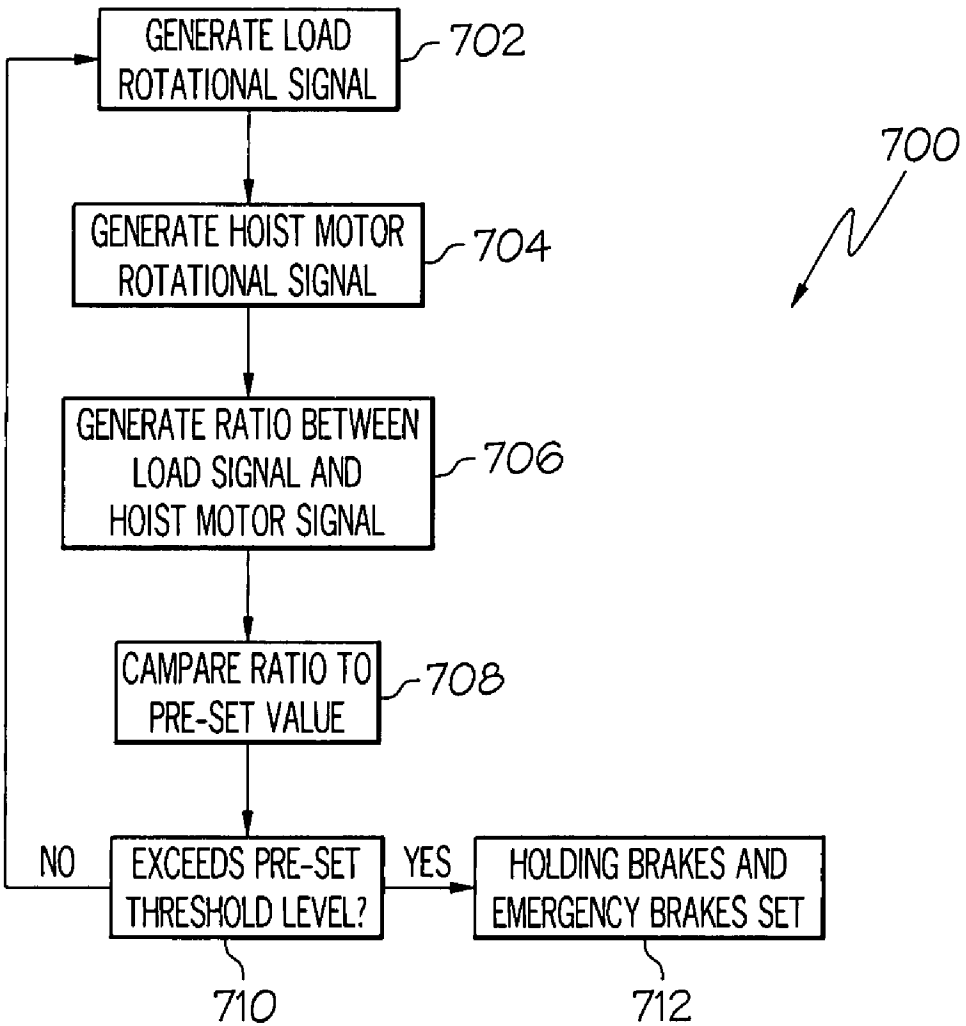
FIG. 7 is a flow chart showing a method for performing a drive train discontinuity function.

FIG. 7 shows the steps taken for performing drive train discontinuity function 700. In step 702, load encoder 130, or load encoder 146, shown in FIGS. 3 and 4, generates a load rotational signal. In step 704, hoist motor encoder 110, shown in FIG. 4, generates a hoist motor rotational signal. In step 706, processor 202, shown in FIG. 4, calculates a ratio between load signal and hoist motor signal. In step 708, processor 202 compares the ratio to pre-set value, in a preferred embodiment a separate processor is used to compare the ratios, while another processor is dedicated to calculating the ratios. In step 710 it is determined if the value of the ratio exceeds a pre-set threshold level. If the answer is no then steps 702-710 are performed again. If the answer is yes, then step 712 occurs and holding shoe brakes 116, and 124, and emergency disc brakes 136, 138, 148, and 150, shown in FIGS. 3 and 4 are set.

During the operation the crane the load speed and the motor speed will be shown on display 210 in order to give the operator a visual indication of the current status of the crane operation. Typically display 210 will show the speeds in feet/minute (or meters/minute).

The differential motion function 800, shown in FIG. 8, will now be discussed. Differential motion comparison is a step beyond the typical diagnostic systems employed in the past, in that it compares the direction and speed of hoist 125 to the direction and speed requested by the operator control stick, 208 shown in FIG. 4 and 5. This comparison ensures that the hoist mechanical and electrical equipment responds to the intended control of the operator and is redundant to the checks made by the hoist drive system controller 152. To achieve this comparison the load bi-directional rotational signal received from load encoders 130, or 146 is converted to a value by processor 202, or alternatively by a processor at encoder 130, or 146, that is compared to the directional and speed reference signals generated by the operator control stick position 208. If a difference is detected holding shoe brakes 116 and 124 and emergency disc brakes 136, 138, 148, and 150 are triggered. Controller 152 calculates a time delay before a fault is latched to prevent nuisance trips due to acceleration and deceleration of the frequency drive or reverse plugging of hoist 125.

Figure 8:
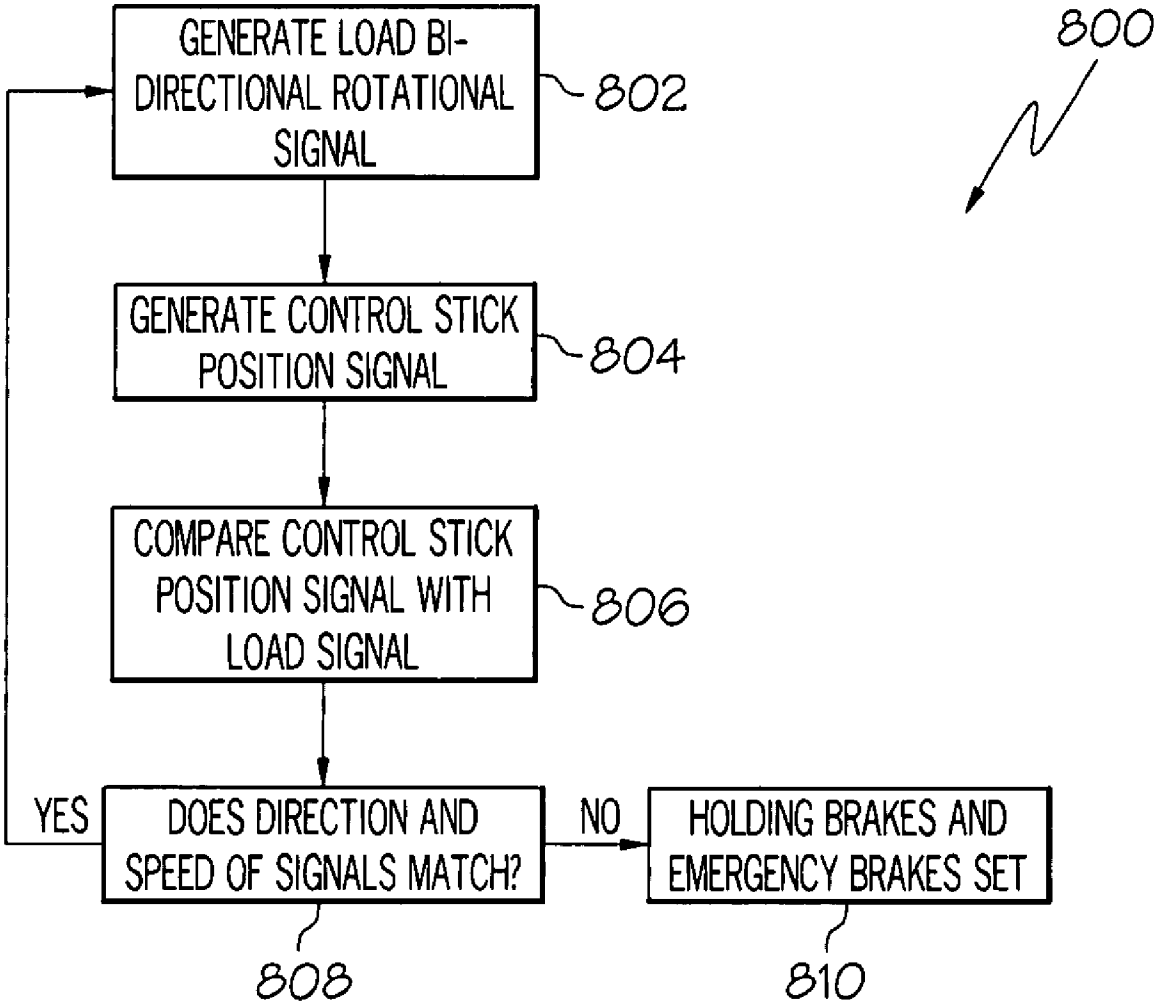
FIG. 8 is a flow chart showing a method for performing a differential motion function.

FIG. 8 shows the steps taken for performing differential function 800. In step 802, load encoder 130, or load encoder 146, shown in FIGS. 3 and 4, generates a load bi-directional rotational signal. In step 804, a control stick position signal is generated. In step 806, control stick position signal is compared with load signal by processor 202, shown in FIG. 4. In step 808 it is determined whether or not the direction and speed of signals match. If the answer is yes then steps 802-808 are performed again. If the answer is no, then step 810 occurs and holding shoe brakes 116, and 124, and emergency disc brakes 136, 138, 148, and 150, shown in FIGS. 3 and 4 are set.

The overspeed and drive train discontinuity functions do not require a directional input from load encoders 130, or 146 or hoist motor encoder 110 to determine if a failure had occurred. However, differential motion does require that the encoders used be capable of a bi-directional signal generator to test for opposite directional conditions. In addition the use of a quadrature sensor device has the added benefit of preventing erroneous speed input due to vibration when the hoist drum is at rest.

The commanded-not-operating function 900 shown in FIG. 9 will now be discussed. Commanded-not-operating function 900 is a subset of differential motion. The commanded-not-operating function 900 is a condition where hoist 125 is commanded to operate but load encoder 130, or alternatively load encoder 146, depending on which drum (120 or 140) is being used, does not respond. Commanded-not-operating function 900 detects lack of load movement with upward or downward input determined from control stick position 208. Commanded-not-operating function 900 also detects failure of encoder feedback and failure of a control circuit. This can be caused by electrical or mechanical failure in the low speed driveline. If there is no response holding shoe brakes 116 and 124, and emergency brakes 136, 138, 148, and 150 are triggered. Controller 152, in order to prevent nuisance trips, compensates for backlash between the hoist motor and hoist drum feedback or the delay of the hoist frequency drive for torque proof testing. Controller 152 can also utilize an alternative version of the commanded-not operated function 900. In the alternative version controller 152 would base its calculations on fractional load revolutions opposite commanded operation and load slip.

Figure 9:
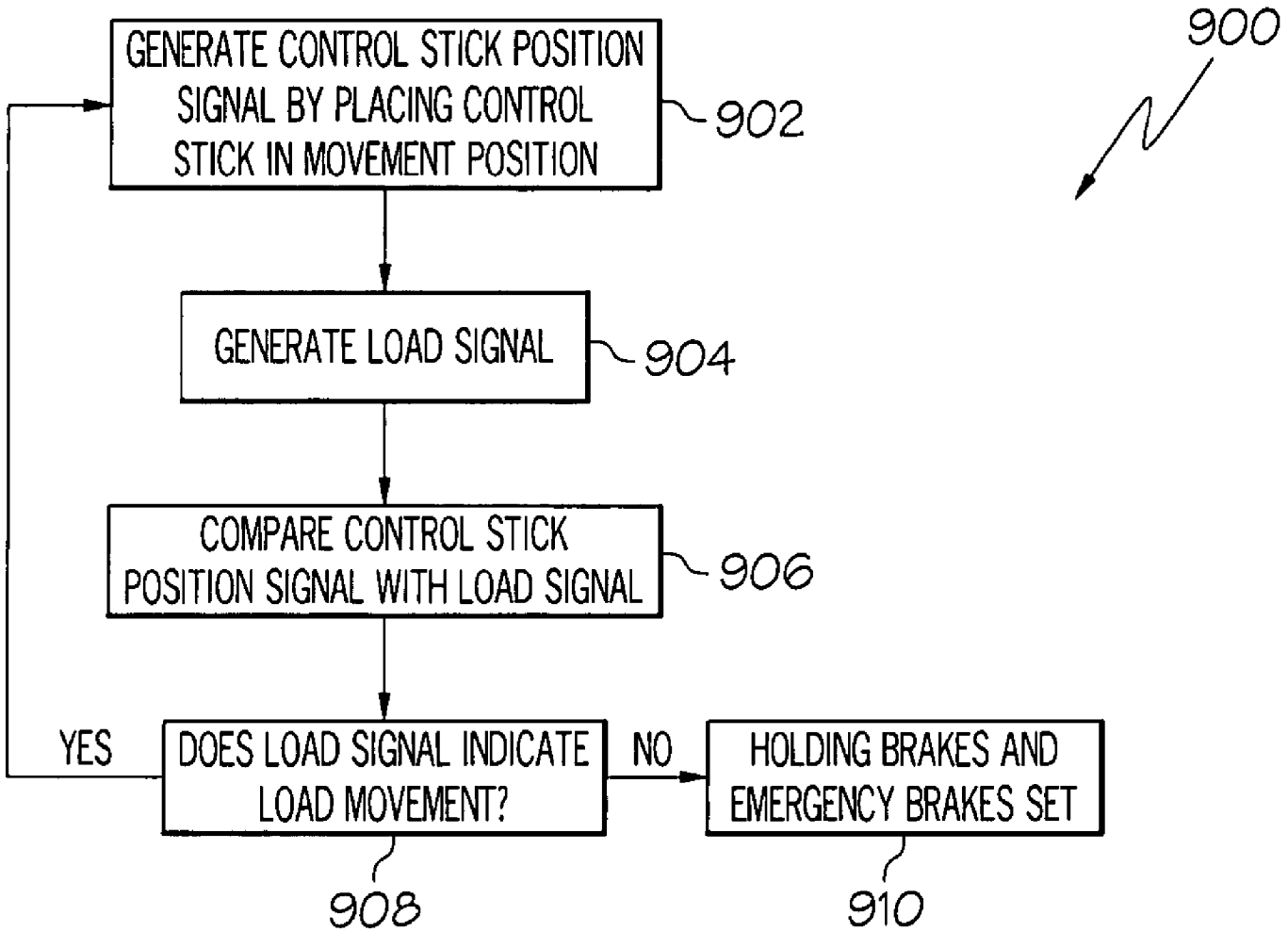
FIG. 9 is a flow chart showing a method for performing a commanded-not-operating function.

FIG. 9 shows the steps taken for performing commanded-not-operating function 900. In step 902, control stick position signal is generated by placing control stick in a movement position. In step 904, load encoder 130, or load encoder 146, shown in FIGS. 3 and 4, generates a load rotational signal. In step 906 the signal is sent to controller 152, shown in FIG. 4, and control stick position signal is compared with load signal. In step 908 it is determined whether the load signal indicates load movement. If the answer is yes, then steps 902-908 are performed again. If the answer is no, then step 910 occurs and holding shoe brakes 116, and 124, and emergency disc brakes 136, 138, 148, and 150, shown in FIGS. 3 and 4 are set.

Figure 10:
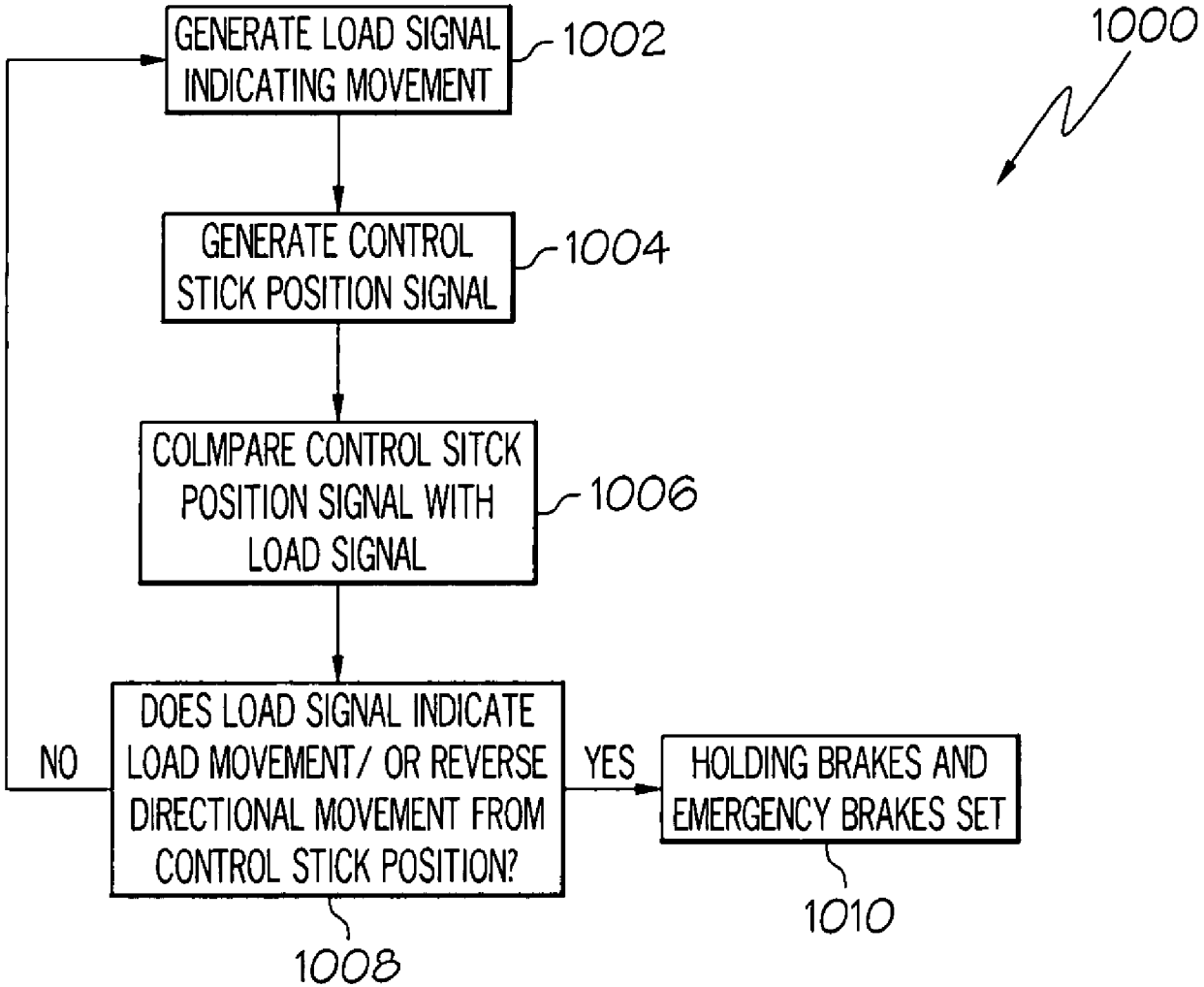
FIG. 10 is a flow chart showing a method for performing an uncommanded motion function.

The uncommanded motion function 1000, shown in FIG. 10, is another subset of differential motion and is the result of hoist drum movement (120 or 140) without input from the operator or a determination of difference in direction between hoist drum (120 or 140) motion and operator control position 208. The uncommanded motion function 1000 detects upward or downward load movement via load encoders 130 or 146 with lack of input from operator control stick and also detects reversal of load rotation from operator control stick position 208. In other words the lower block should only move or move in the selected direction when the operator commands the operation. If uncommanded motion occurs holding shoe brakes 116 and 124, and emergency brakes 136, 138, 148, and 150 are triggered. Controller 152, in order to prevent nuisance trips, provides a time delay to compensate for deceleration of hoist drive motor 112 to a stop or reverse plugging of the hoist 125.

FIG. 10 shows the steps taken for performing uncommanded motion function 1000. In step 1002, load encoder 130, or load encoder 146, shown in FIGS. 3 and 4, generates a load rotational signal indicating movement. In step 1004 a control stick position signal is generated. In step 1006 control stick position signal is compared with load signal by processor 202, shown in FIG. 4. In step 608 it determined whether or not the load signal indicates load movement or reverse directional movement from the control stick position signal. If the answer is no then steps 1002-1008 are performed again. If the answer is yes, then step 1010 occurs and holding shoe brakes 116, and 124, and emergency disc brakes 136, 138, 148, and 150, shown in FIGS. 3 and 4 are set.

Controller 152 further provides an in-motion function that detects upward or downward load movement to provide an indication to the operator of the motion of drum (120 or 140).

Figure 11:
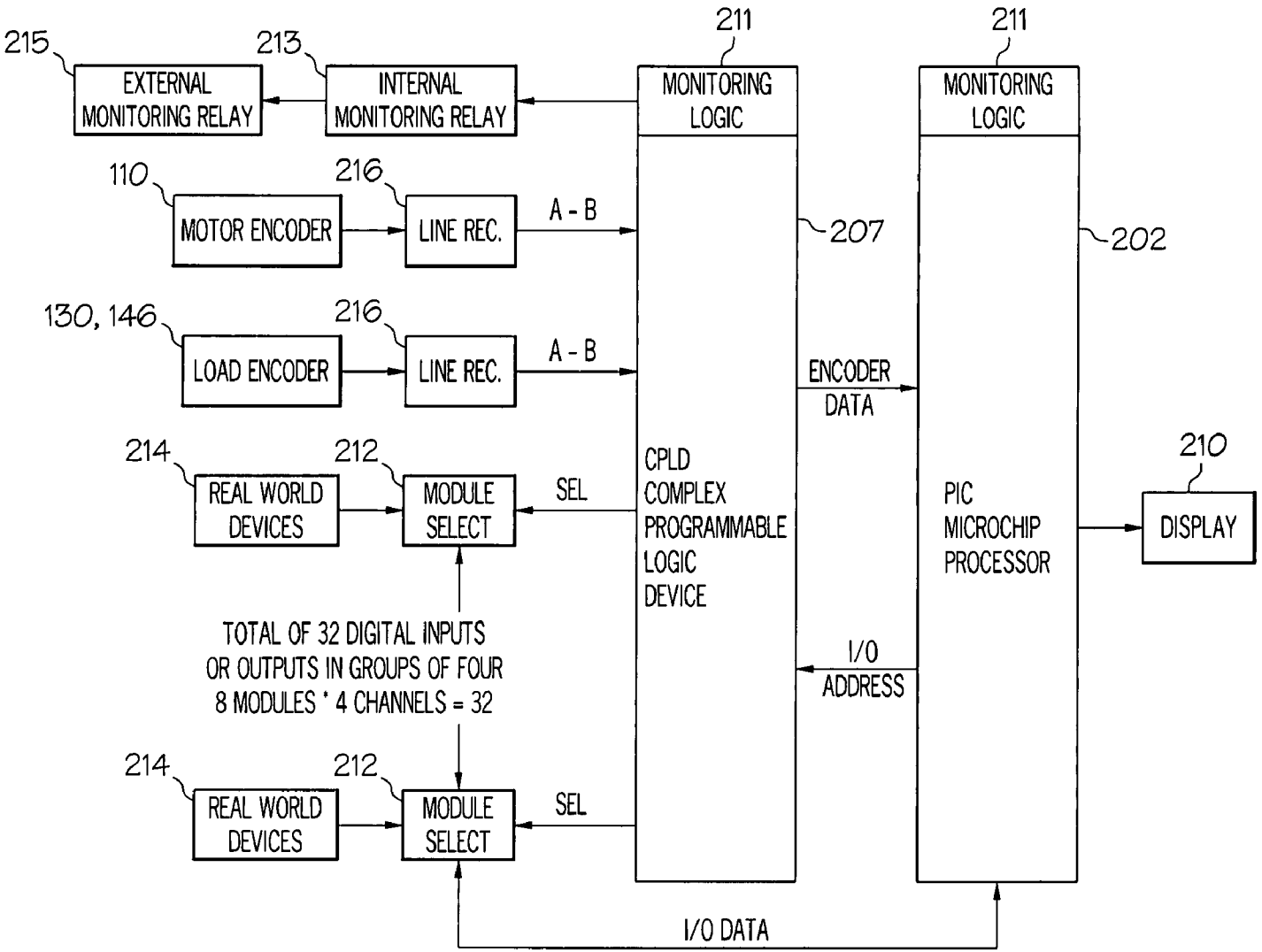
FIG. 11 is an internal diagram of the controller logic.

In one embodiment, monitoring circuit 205, shown in FIGS. 4 and 5, is employed within controller 152 in order to detect failure of the processors and components used, such as processor 202 and any dedicated processors assigned to perform specific tasks within controller 152. Monitoring circuit 205 is constructed with a variety of hardware and software components. Monitoring circuit 205 functions to detect failures with processor 202, such as a Microchip PIC series Microcontroller and CPLD 207 (Complex Programmable Logic Device) hardware and software. Monitoring circuit 205 also functions to detect 5 VDC and 12 VDC power supply failure. Upon detection of a failure condition, monitoring circuit 205 sends a signal to hoist controller 204, which will trigger holding shoe brakes 116, 124, and emergency disc brakes 136, 138, 148, 150. FIG. 11 shows an internal diagram of an embodiment of controller 152. In this embodiment, processor 202 is a PIC Microchip Processor. Processor 202 works with monitoring logic 211, which monitors hardware and software failure. CPLD 207 and monitoring logic 211 monitors hardware and software failure. Monitoring logic 211 sends signals to internal monitoring relay 213, which then sends signals to external monitoring 215, which then sends the signal to hoist controller 205 which will trigger the activation of the brakes. Motor encoder 110 and load encoders 130, 146 have encoder line receivers 216. Encoder line receivers 216 permit the use of quadrature differential encoders for long distance operation. Encoder line receivers 216 further have +/−15 kV ESD (Electrostatic Discharge) protection and increased common mode rejection. The encoder line receivers 216 have alarm flags that indicate open or shorted line conditions, excessive common-mode voltage range, and low signal strength. The encoder line receivers 216 may also trigger activation of the brakes in the event that one of the above conditions is detected.

Additional real world devices 214 may be added to controller 152 via an additional 32 digital inputs and/or outputs in groups of four (i.e. 8 modules times 4 channels equals 32 I/Os). Rack mounted modular I/O units allow a mix of analog, digital and serial inputs and outputs at different voltage level. A universal logic recognized rack has I/O modules ranging from 5 VDC to 240 VDC. Module select 212 permits the selection of the module to use.

Figure 12:
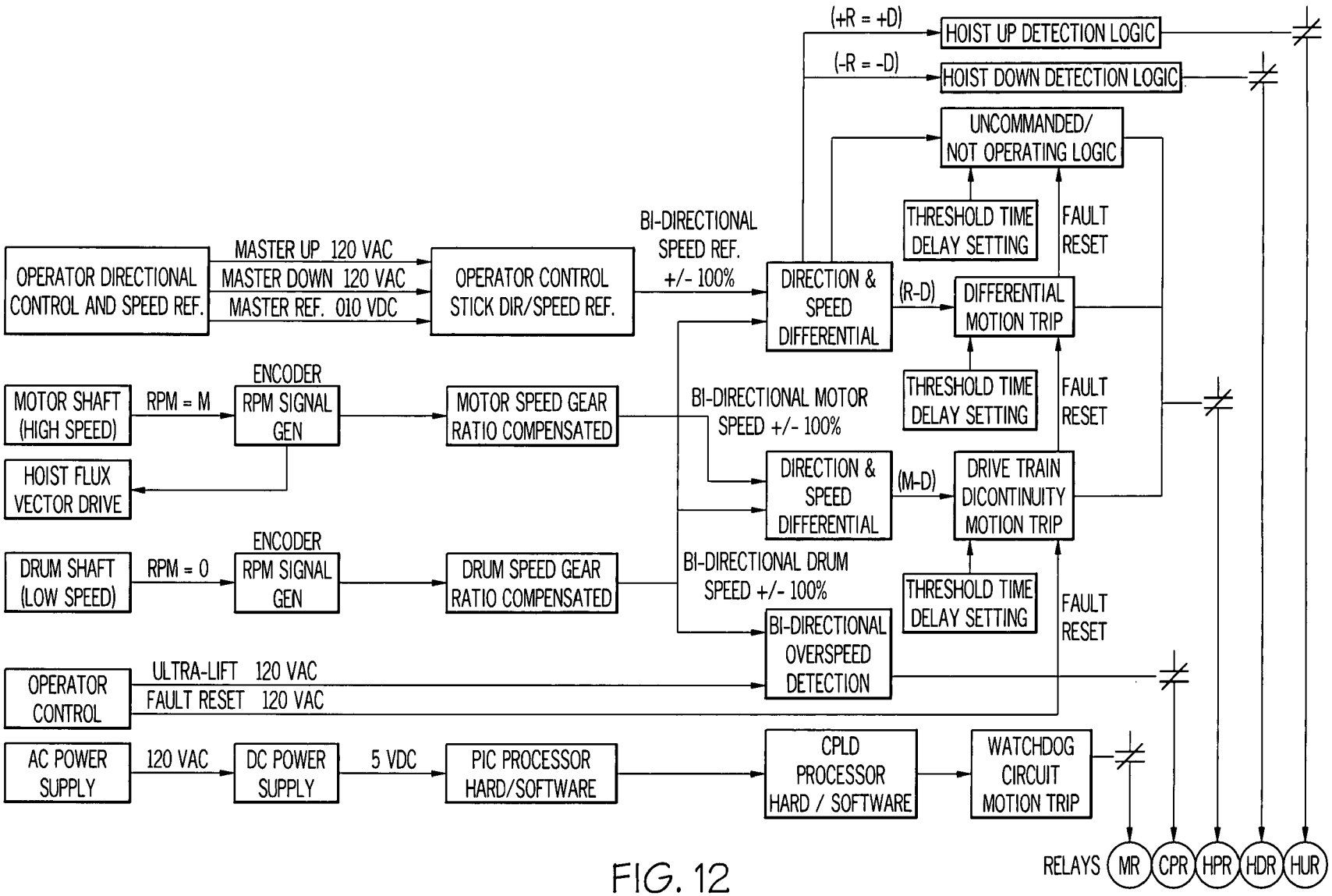
FIG. 12 is a logic diagram depicting the functioning of a controller.

FIG. 12 shows a logic diagram depicting the functioning of controller 152 for performing overspeed function 600, differential motion function 800, drive train discontinuity 700, commanded-not-operating function 900, and uncommanded motion function 1000, shown in FIGS. 6-10 above. Also shown is MR (Monitoring relay) for use with monitoring circuit 205. In FIG. 12, CPR is the Crane Permissive Relay, HPR is the Hoist Permissive Relay, HDR is the Hoist Down Relay, and HUR is the Hoist Up Relay.

Figure 13:
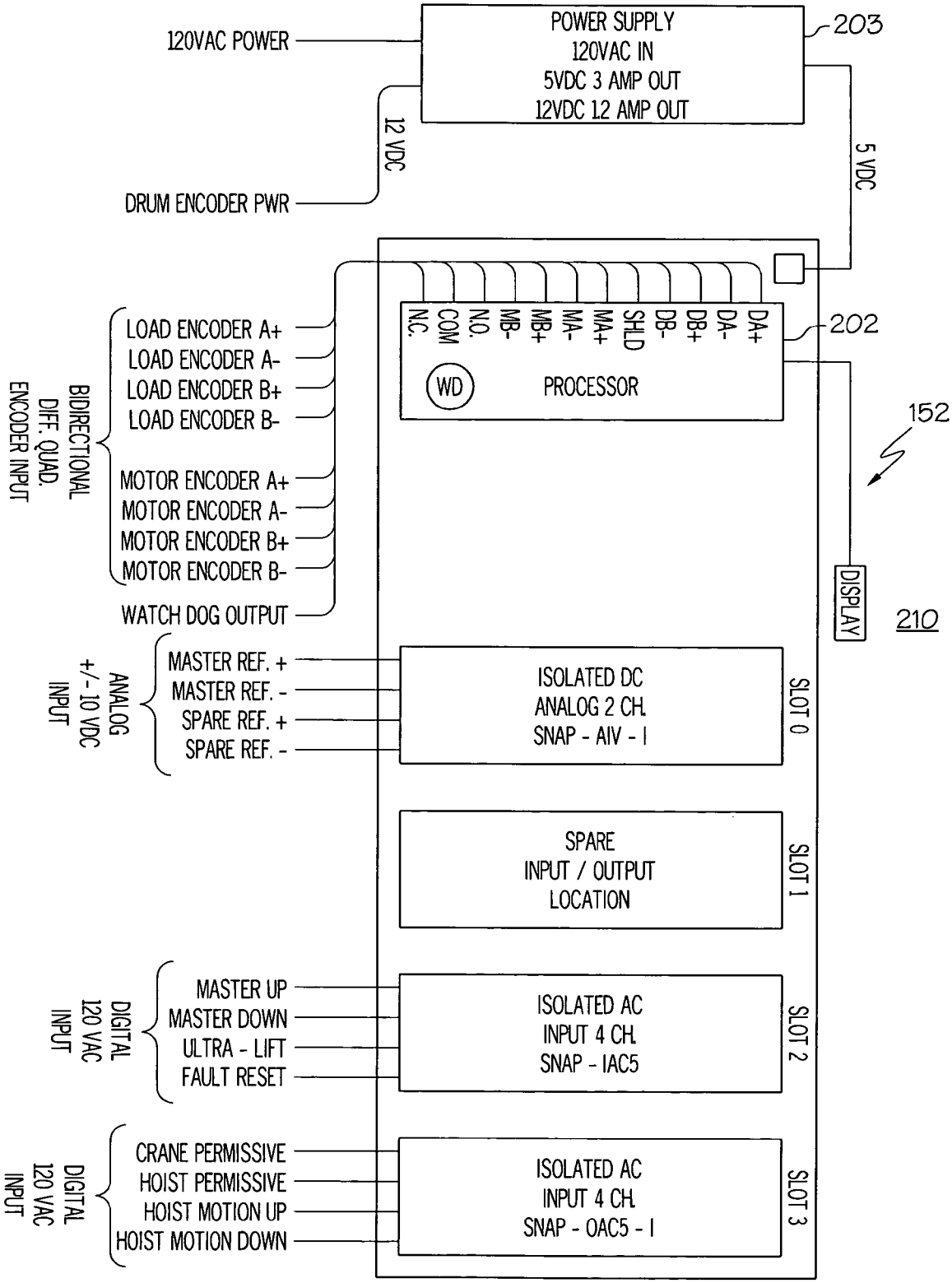
FIG. 13 is block diagram showing inputs and outputs for a controller.

FIG. 13 shows a block diagram showing inputs and outputs for controller 152. Additionally, a back-up power can be installed with controller 152 in the event that external power supply 203 fails. Controller 152 can use an extended I/O rack to connect additional safety related equipment. Additionally processor 202 can be connected to a data storage unit, such as a hard drive, in order to log fault conditions when they occur. Logging fault events can assist in determining the root of a problem if a failure event continues to occur.

Figure 14:
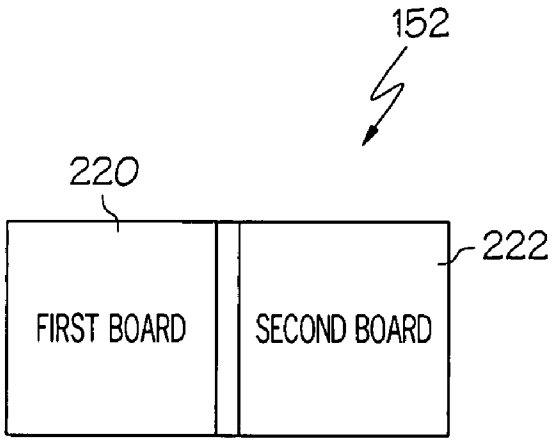
FIG. 14 is a block diagram showing the arrangement of circuit boards on a controller.

FIG. 14 shows a block diagram illustrating the possible location of board components in an embodiment of controller 152. Controller 152 comprises a first board 220 and a second board 222. First board 220 and second board 222 have the hardware and software that comprise processor 202, monitoring circuit 205 and hoist controller 204, shown in FIGS. 4 and 5. First board 220 and second board 222 are printed circuit boards. The two boards have hardware code and firmware code that are in the form of schematics that are compiled into loadable code for complex programmable logic device (CPLD) 207 and code for processor 202. First board 220 functions as the main board while second board 222 functions as an interface board that can also provide means for expansion. Although two boards are shown in FIG. 14, it is well understood in the art that a single board may be employed, or alternatively, more than two boards may be employed.

First board 220 and second board 222 set contain specific hardware and firmware for a variety of functions. One function is the demodulation of two channels of RS-422 compatible A quadrature B encoder inputs. Other functions include driving of a serial interface LCD panel, transmitting and receiving RS-232 serial data, having an interface to a standard OPTO-22 module rail containing standard OPTO-22 modules, having a monitoring timer circuit 240 that drives a relay to provide an external contact closure to indicate processor 202 faults and having an interface to reprogram CPLD 207 and processor 202 on the board.

Figure 15:
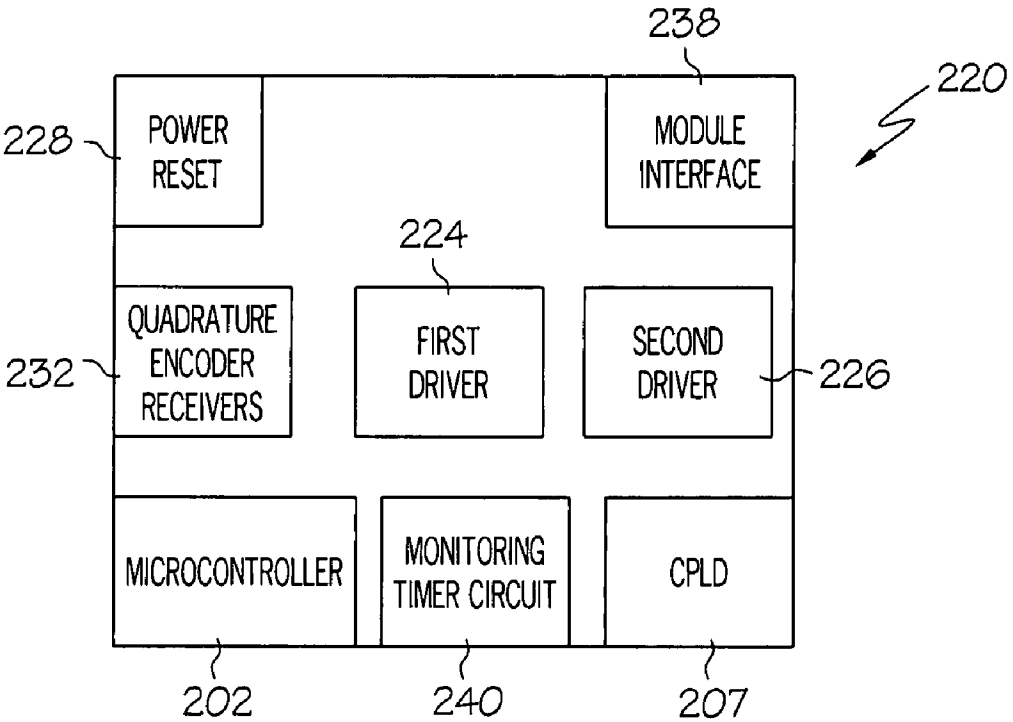
FIG. 15 is a block diagram showing the arrangement of components on a circuit board.

FIG. 15 shows a block diagram of the components on first board 220. First board 220 functions as the main board for controller 152. First board 220 has processor 202, and those components that form monitoring circuit 205 and hoist controller 204. Those components that form monitoring circuit 205 and hoist controller 204 are, monitor timer circuit 240, quadrature encoder receiver 232, power-up reset 228, first driver 224, module interface 238, second driver 226, and CPLD 207.

Processor 202 is a microcontroller formed with a Microchip PIC16F877 running at 20 MHz. Processor 202 utilizes various software in its functioning. Some of the software used is for interfacing with module interface 238, interfacing with CPLD 207, and for interfacing with UART (universal asynchronous receiver transmitter) signals.

Power-up reset 228 uses a Maxim™ DS1813 IC and is part of monitoring circuit 205. The power-up reset 228 IC senses when the power supply voltage exceeds a threshold level. Upon sensing that the supply voltage exceeds a threshold level a timer is started. After the time-out, the output line reset is taken inactive thereby allowing processor 202 to start. Pressing reset button 244 on the second board 222, shown in FIG. 16, also pulls the reset line active. The power-up reset 228 IC senses this and will continue to hold the reset line active until the reset button is released and the timer times out.

Figure 16:
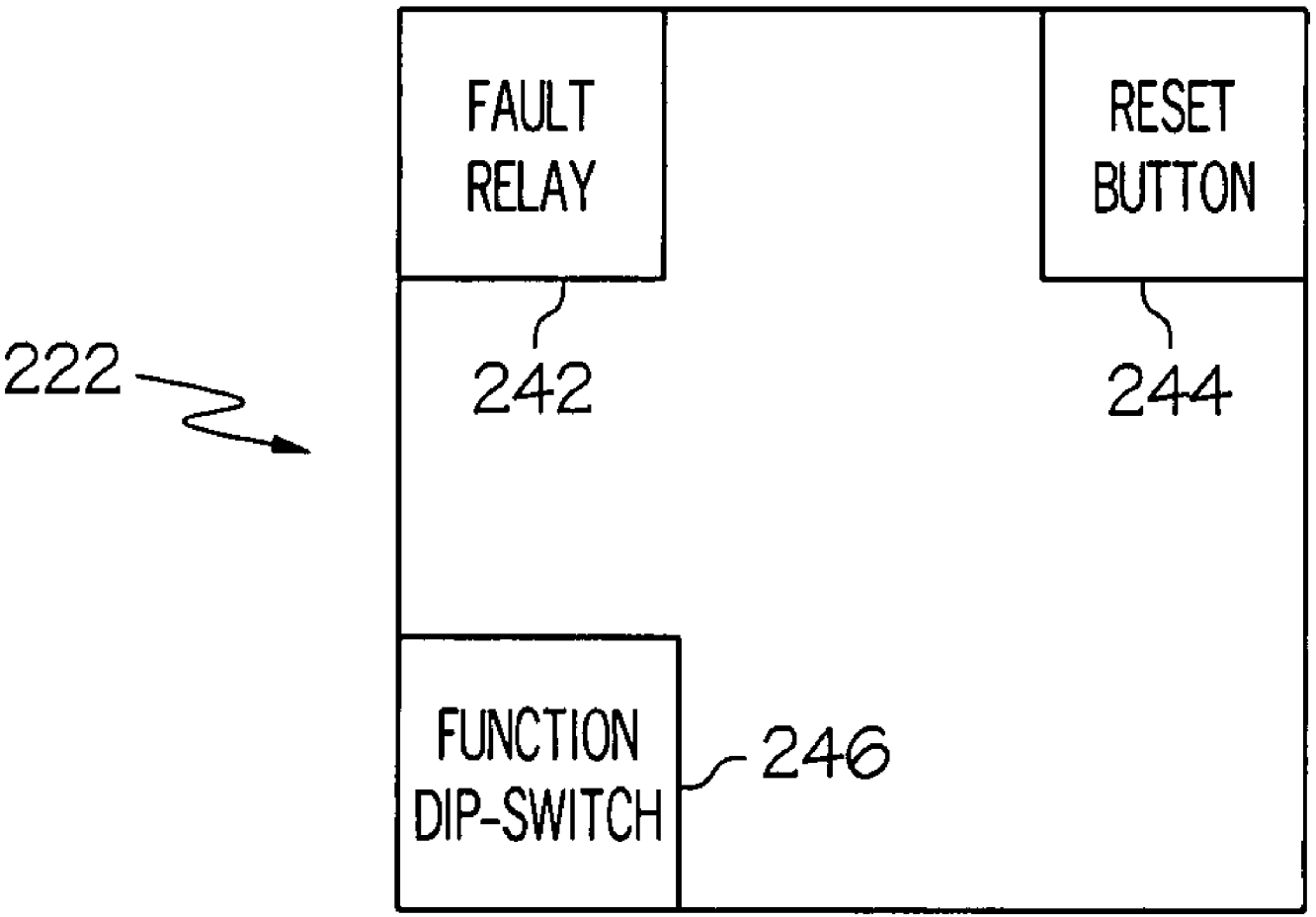
FIG. 16 is a block diagram showing the arrangement of components on a circuit board.

A special monitor timer circuit 240 consists of a re-triggerable monostable multivibrator with a one second time-out, a flip-flop, and a two input NAND gate driving the output relay. Monitor time circuit 240 also forms part of monitor circuit 205. At power-up, or if reset button 244, shown in FIG. 16, is pressed, the flip-flop is cleared. This forces the NAND gate to not drive the relay, which indicates a fault condition. When processor 202 starts to pulse the monostable's input the monostable's output goes high into the NAND gate along with the state from the flip-flop causing the relay to be driven and indicating a no fault condition. No fault is maintained as long as processor 202 keeps pulsing monitor timer circuit 240 before the one-second time-out. If processor 202 does not re-pulse the monostable within one second, the monostable's output will go low. This toggles the flip-flop state. As a result the NAND gate de-energizes the relay indicating a fault condition. No further pulsing of the monostable by processor 202 can remove the fault condition. Only by activating power-up reset 228, or reset button 244 on second board 222, followed by processor 202 pulsing can remove the fault.

First driver 224 is a Maxim™ MAX232 IC and is used for the RS-232 interface. Second driver 226, uses a Maxim™ MAX483 IC. First driver 224 and second driver 226 are components of hoist controller 204. Second driver 226 is used for the RS-485 interface. Processor's 202 internal UART is used for serial transmit and receive functions. The UART signals and the RS-232 and RS-485 signals are all routed through CPLD 207 where firmware uses the DIP-Switch inputs to route serial communication data as required. RS-232 is used for external diagnostic purposes in conjunction with a PC running terminal emulation software. RS-485 is used by the OPTO-22 interface. Quadrature encoder receivers 232 use Maxim™ MAX3097 IC and are a component of monitoring circuit 205. Quadrature encoder receivers 232 are used for receiving the RS-422 A quadrature B signals from the encoders. These devices are specifically designed for quadrature signal reception with special fault detection logic. The output from the quadrature encoder receivers 232, including fault signals, are routed to CPLD 207 for demodulation.

CPLD 207 is a Xilinx® XC95144 complex programmable logic device and is a component of monitoring circuit 205. CPLD 207 can be programmed on first board 220 and contains 3200 gates. A 20 MHz TTL oscillator clock is used to provide clock data to CPLD 207. CPLD 207 is programmed with firmware to implement various functions. Firmware that is programmed into CPLD 207 is first generated as schematics that are then compiled into downloadable code. The downloadable code is used to program CPLD 207 on first board 220. An example of the type of downloadable code that can be used is Xilinx® WebPack tools, however other software tools may be used.

Support logic in the firmware for the CPLD 207 can be broken into six categories; general support logic, fast encoder counter logic, slow encoder counter logic, encoder signal filters, encoder edge detectors, and fast and slow counter control logic.

The general support logic in the firmware located in CPLD 207 performs a variety of tasks. The general support logic causes the monitor pulse from processor 202, which functions as a microcontroller, to be passed through CPLD 207 without modification. Additionally, a 20 MHz TTL oscillator signal is used internally by CPLD 207 firmware and is also buffered through to processor 202 as its main clock. With the general support logic a three-line to eight-line decoder is used to decode OPTO-22 slot addresses from processor 202 into slot enable signals for eight multiplexer ICs. The general support logic also uses a serial data multiplexer that uses the first two DIP switches from Function DIP switch 246 to set data routing for the RS-232, RS-485 and microcontroller UART signals. General support logic also synchronizes the serial clock generated by processor 202 with the 20 MHz clock. This serial clock is used in shifting data between the processor 202 and CPLD 207. The general support logic combines the various fault indicator signals from the A quadrature B RS-422 line receivers to make a processor 202 interrupt signal and status bits for the slow and fast decoder data registers in the firmware.

CPLD 207 uses fast encoder counter logic to interpret signals from motor encoder 110. The fast encoder counter logic is built from a 9 bit adder and a 16 bit latch/shift register. A direction line causes either a plus one or minus one to be added to the current value in the latch register. After the count has accumulated in the lower 9 bits of the 16-bit latch, an overflow bit is saved along with a status bit showing any faults from the RS-422 A quadrature B line receiver. The rotation direction is determined from the A quadrature B signals in the encoder edge decoder logic described in more detail below. After the value is accumulated in the latch, the fast encoder counter logic then operates as a shift register and processor 202 serially shifts out the data.

Fast counts are accumulated for one interval of the slow count A quadrature B period which is the time from any two edges as determined by the encoder edge decoder logic. The fast encoder counter logic counts fast encoder edges.

CPLD 207 uses slow encoder counter logic to interpret signals from load encoders 130 and 146. The slow counter logic is built from a 24 bit adder and a 32 bit latch/shift register. A direction line causes either a plus one or minus one to be added to the current value in the latch register. After the count has accumulated in the lower 24 bits of the 32 bit latch an overflow bit is saved along with a status bit showing any faults from the RS-422 A quadrature B line receiver and a second status bit showing any edge sequencing errors for the slow encoder. The rotation direction is determined from the A quadrature B signals in the encoder edge decoder logic. After the value is accumulated in the latch, slow encoder counter logic then operates as a shift register and processor 202 serially shifts out the data.

Slow counts are accumulated for one interval of the slow count A quadrature B period which is the time from any two edges as determined by the encoder edge decoder logic. The slow encoder counter logic counts 20 MHz clock edges.

CPLD 207 also uses fast and slow encoder filters. Fast and slow encoder filters synchronize the A quadrature B signals with the 20 MHz clock used in the CPLD 230 and remove any "glitches" on the signal edges using a digital low pass filter implementation.

CPLD 207 uses fast and slow encoder edge decoders. The fast and slow encoder edge detectors detect eight possible edge states of the two quadrature input lines. Any edge in one signal line has a corresponding level on the quadrature signal line. This allows any edge to be identified with respect to rotational direction: forward or reverse. The decoder outputs a one pulse for a forward edge and another pulse for a reverse edge, both for slow and fast encoder inputs.

CPLD 207 also uses fast and slow counter control logic. The fast and slow counter control logic generates gates to enable counting edges in the fast and slow counters. The slow counter is gated to count 20 Mhz clock edges for one period between any two adjacent slow encoder edges signals, such as those from load encoders 130 and 146. The fast counter counts fast encoder signal edges, such as those from motor encoder 110, over the same interval the slow counter counts 20 MHz clock edges. Therefore the slow counter provides an absolute measurement of the rotation rate (relative to the 20 MHz clock) and the fast counter provides how many fast edges occur during a slow count period.

This fast and slow counter control logic also provides a secondary function of notifying processor 202 of when a complete set of measurements have been made and also providing the logic to clear the fast and slow latches to ready them for counting a new set of data and for the generation of the counter direction signals.

Module interface 238 is the OPTO-22 interface. Module interface 238 is composed of two separate parts: the RS-485 bi-directional serial interface and a four bit parallel bi-directional interface to the 8 OPTO-22 slots. The four bit parallel interface is implemented with a bi-directional multiplexed consisting of eight Maxim™ MAX4616 ICs. Processor 202 specifies which slot to interface with and the direction of the transfer. CPLD 207 decodes processor's 202 slot address and enables the multiplexer switch.

FIG. 16 shows a block diagram of second board 222. Second board 222 is an interface board and can further provide additional expansion for controller 152. Second board 222 has fault relay 242, reset button 244 and function dip-switch 246.

Fault relay 242 is a double pole double throw device having two sets of contacts and is forms part of monitoring circuit 205, and driven by components located on first board 220. One set of contacts is used to report a fault externally if the relay is non-energized. The second set of contacts is used to report the relay state back to processor 202.

Reset button 244 is connected to the power-up reset 228 on first board 220. Activating reset button 244 provides a result that is identical to the result achieved when power-up reset 228 is activated. When reset button 244 is activated processor 202 is restarted and monitor timer circuit 240 is reset.

Function DIP-switch 246 is part of monitoring circuit 205. Function DIP-switch 246 has multiple DIP-switches that are connected to CPLD 207 on first board 220 to be used in setting various configurations for the functioning of monitoring circuit 205. CPLD's 207 firmware uses the DIP-switch to set the routing of the RS-232/485 serial data for various test and operational modes. An example of the settings for function DIP-switch 246 are provided below in Table 1.

TABLE 1

| Switch 1 | Switch 2 | Function |
|---|---|---|
| On | On | PIC drives RS-485, RS-232 monitors RS-485 data |
| On | Off | PIC drives RS-232, RS-485 not connected |
| Off | Off | RS-232 drives RS-485, PIC not connected |

The first state, where switch 1 is in the On position and switch 2 is in the On position, is the operational mode. The second state, where switch 1 is in the On position and switch 2 is in the Off position, is the diagnostic state for PIC debugging. The third state, where switch 1 is in the Off position and switch 2 is in the Off position is for OPTO-22 debugging without using the PIC. In alternative embodiments additional switches can be added in order to provide additional states and functions.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hoisting system comprising:

a hoist for lifting a load;

brakes connected to said hoist;

an operating system for operating said hoist; and a controller for providing single failure proof operation comprising a command-not-operated function that causes braking of said hoist when an encoder detects one of a group of conditions consisting essentially of: (1) a lack of load movement when a movement command is issued by said operating system, (2) failure of encoder feedback, or (3) failure of a control circuit.

2. The hoisting system of claim 1, wherein said command-not-operated function further comprises a programmed time delay.

3. The hoisting system of claim 2, wherein said programmed time delay compensates for a time delay caused by at least one of backlash and, hoist drive torque proof testing.

4. The hoisting system of claim 1, wherein said controller further comprises an overspeed function that causes braking of said hoist when an encoder detects one of a group of conditions consisting of; (1) a load movement exceeding a predetermined threshold speed in an upward direction, or (2) a load movement exceeding a predetermined threshold speed in a downward direction.

5. The hoisting system of claim 4, wherein said controller further comprises a differential motion function that causes braking of said hoist when a direction and speed of a load movement does not match a direction and speed of a load movement command issued by said operating system.

6. The hoisting system of claim 5, further comprising;

a high speed driveline and a low speed driveline; and wherein said controller further comprises a drive train discontinuity function that causes braking of said hoist when a predetermined ratio difference between said high speed driveline speed and said low speed driveline speed is exceeded.

7. The hoisting system of claim 1, wherein said controller further comprises a differential motion function that causes braking of said hoist when a direction and speed of a load movement does not match a direction and speed of a movement command issued by said operating system.

8. The hoisting system of claim 1, further comprising:

a high speed driveline and a low speed driveline; and wherein said controller further comprises a drive train discontinuity function that causes braking of said hoist when a predetermined ratio difference between said high speed driveline speed and said low speed driveline speed is exceeded.

9. The hoisting system of claim 1, wherein said encoder is a quadrature encoder.

10. A hoisting system comprising:

a hoist for lifting a load;

brakes connected to said hoist;

an operating system for operating said hoist; and a controller for providing single failure proof operation comprising:

an uncommanded motion function that causes braking of said hoist when an encoder detects one of a group of conditions consisting of; (1) load movement without a movement command issued by said operating system, or (2) reverse directional movement of said load from a directional movement command input by said operating system.

11. The hoisting system of claim 10, wherein said controller further comprises an overspeed function that causes braking of said hoist when an encoder detects one of a group of conditions consisting of: (1) a load movement exceeding a predetermined threshold speed in an upward direction, or (2) a load movement exceeding a predetermined threshold speed in a downward direction.

12. The hoisting system of claim 11, wherein said controller further comprises a differential motion function that causes braking of said hoist when a direction and speed of a load movement does not match a direction and speed of a movement command issued by said operating system.

13. The hoisting system of claim 12, further comprising;

a high speed driveline and a low speed driveline;

wherein said controller further comprises a drive train discontinuity function that causes braking of said hoist when a predetermined ratio difference between said high speed driveline speed and said low speed driveline speed is exceeded.

14. The hoisting system of claim 13, wherein said controller further comprises a command-not-operated function that causes braking of said hoist when an encoder detects one of a group of conditions consisting of (1) a lack of load movement when a movement command is issued by said operating system, (2) failure of encoder feedback, or (3) failure of a control circuit.

15. The hoisting system of claim 14, further comprising a programmed time delay before a function is triggered.

16. The hoisting system of claim 15, wherein said programmed time delay compensates for at least one of hoist drive deceleration and, operator reverse plugging.

17. The hoisting system of claim 15, wherein said programmed time delay compensates for at least one of hoist drive deceleration and, operator reverse plugging.

18. The hoisting system of claim 10, wherein said uncommanded motion function further comprises a programmed time delay.

19. The hoisting system of claim 18, wherein said programmed time delay compensates for at least one of hoist drive deceleration and, operator reverse plugging.

20. The hoisting system of claim 10, wherein said encoder is a quadrature encoder.

21. A method of retrofitting a crane assembly with an improved controller, comprising the steps of:

providing a controller providing a single failure proof operation comprising a command-not-operated function that causes braking of a hoist when an encoder detects one of a group of conditions consisting off: (1) a lack of load movement when a movement command is issued by said operating system, (2) failure of encoder feedback, or (3) failure of a control circuit.

22. A method of retrofitting a crane assembly with an improved controller, comprising the steps of:

providing a controller providing a single failure proof operation comprising an uncommanded motion function that causes braking of a hoist when an encoder detects one of a group of conditions consisting of: (1) load movement without a movement command issued by said operating system, or (2) reverse directional movement of a load from a directional movement command input by said operating system.

23. A method of providing a lift hoisting diagnostic system comprising the steps of:

operating an operating system for moving a crane;

issuing a command to move a load with said operating system;

detecting non-movement of said load with an encoder;

transmitting a signal from said encoder to a controller;

comparing said command to move with said signal from said encoder;

transmitting from said controller a command to a braking system; and braking said crane.

24. The method of providing a lift hoisting diagnostic system of claim 23, further comprising the step of: compensating for a time delay caused by at least one of backlash and, hoist drive torque proof testing.

25. A method for providing a hoisting diagnostic system comprising steps of:

detecting movement of a load with an encoder:

transmitting a signal from said encoder to a controller;

transmitting a signal from an operating system for commanding movement of said load to said controller;

comparing said signal from said encoder with said signal from said operating system;

transmitting from said controller a command to a braking system; and braking said crane.

26. The method of providing a hoisting diagnostic system of claim 25, further comprising the step of compensating for a time delay due to at least one of hoist drive deceleration and, operator reverse plugging.

27. A hoisting diagnostic apparatus comprising;

a controller for providing single failure proof operation comprising;

a command-not-operated function that causes braking of a hoist when an encoder detects one of a group of conditions consisting of: (1) a lack of load movement when a movement command is issued by a operating system, (2) failure of encoder feedback, or (3) failure of a control circuit.

28. A hoisting diagnostic apparatus comprising;

a controller for providing single failure proof operation comprising:

an uncommanded motion function that causes braking of a hoist when an encoder detects one of a group of conditions consisting of: (1) load movement without a movement command issued by an operating system, or (2) reverse directional movement of a load from a directional movement command input by said operating system.

29. A hoisting diagnostic apparatus comprising:

a controller for operating a crane comprising:

a complex programmable logic device for receiving signals;

a processor for interfacing with said complex programmable logic device; and wherein said complex programmable logic device is programmed with encoder counter logic.

30. The hoisting diagnostic apparatus of claim 29, wherein said complex programmable logic device further comprises encoder signal filters.

31. The hoisting diagnostic apparatus of claim 29, wherein said complex programmable logic device further comprises encoder edge decoders.

32. The hoisting diagnostic apparatus of claim 29, wherein said complex programmable logic device further comprises encoder counter control logic.

* * * * *